United States Patent [19]

Mortimer

[11] Patent Number: 4,688,231

[45] Date of Patent: Aug. 18, 1987

[54] INDUCTION FURNACE PACKAGING SYSTEM

[75] Inventor: John H. Mortimer, Medford, N.J.

[73] Assignee: Inductotherm Corp., Rancocas, N.J.

[21] Appl. No.: 911,599

[22] Filed: Sep. 25, 1986

Related U.S. Application Data

[63] Continuation-in-part of Ser. No. 761,272, Aug. 1, 1985, Pat. No. 4,639,931.

[51] Int. Cl.[4] ..... H05B 5/00

[52] U.S. Cl. ..... 373/138; 373/142; 373/151

[58] Field of Search ..... 373/138, 142, 143, 151–158, 373/150; 266/142; 432/62, 93; 219/10.75

[56] References Cited

U.S. PATENT DOCUMENTS

| | | | |
|---|---|---|---|
| 1,246,148 | 11/1917 | Owens . | |
| 1,288,975 | 12/1918 | Owens . | |
| 1,452,856 | 4/1923 | Trinks . | |
| 2,176,674 | 10/1939 | Lindemuth | 263/15 |
| 2,408,350 | 9/1946 | Strickland, Jr. | 219/13 |
| 2,681,971 | 6/1954 | Strickland, Jr. et al. | 219/13 |
| 2,768,226 | 10/1956 | Rowan, Jr. et al. | 13/26 |
| 3,401,227 | 9/1968 | Dunlevy et al. | 373/155 |
| 3,476,372 | 11/1969 | Tezuka | 266/13 |

*Primary Examiner*—Roy N. Envall, Jr.

*Attorney, Agent, or Firm*—Seidel, Gonda, Goldhammer & Abbott

[57] ABSTRACT

A packaging system for an induction furnace has an equipment housing within which is located all the operating equipment for the furnace. The equipment is centrally located within the housing and is reached by access panels in the housing cover, which forms a deck. The operating equipment is fully enclosed and protected by the housing, yet can be easily reached by means of the access panels for maintenance, troubleshooting and the like.

3 Claims, 4 Drawing Figures

INDUCTION FURNACE PACKAGING SYSTEM

CROSS-REFERENCE TO RELATED APPLICATION

This application is a continuation-in-part of copending application Ser. No. 761,272, filed Aug. 1, 1985, now U.S. Pat. No. 4,639,931 which is incorporated herein by reference.

BACKGROUND OF THE INVENTION

Induction furnaces of less than five ton capacity have in the past been sold with their power supplies in a heavy gauge cubicle and the furnace separate therefrom. It has been up to the customer to install and provide platforms and supports for the furnaces and power supply cubicles. In cases where the furnaces and the power supplies have been packaged together, the packaging has been done in such a way that many of the furnace components are located in structures that protrude above the deck working area. Attempts to locate some of the components below a prepackaged deck have necessitated removal of deck plates to work directly underfoot to do maintenance on the equipment.

There is a need for a packaging system that incorporates an open deck area where only the necessary operating controls protrude above the deck area and the remaining furnace components are under the deck area, but arranged so that access for maintenance purposes is from the side rather than directly underfoot. There is also a need for a packaging system to accomodate a furnace of the type having a push-out lining which can be removed and discarded when worn out.

The present invention fulfills these needs.

SUMMARY OF THE INVENTION

The invention is a packaging system for induction furnaces and comprises a housing having a base, side walls and a top wall, the base, side and top walls defining an enclosed space. An induction furnace of the type having a removable liner is contained substantially within the enclosed space along with means for tilting the furnace about an axis perpendicular to the furnace axis. Furnace operating equipment, including means operatively associated with the furnace for at least partially ejecting the removable liner from the furnace, is centrally located within the enclosed space and defines a space between the operating equipment and a side wall of the housing. Access means are provided in the top wall adjacent the space between the operating equipment and the side wall for providing access to the space and the operating equipment from the side while preventing access to the equipment from the top. The packaging system further includes furnace charging means mounted on the housing adjacent and pivotable with respect to the furnace for charging it with metal to be melted, and furnace control housing means mounted on the top wall adjacent the furnace.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
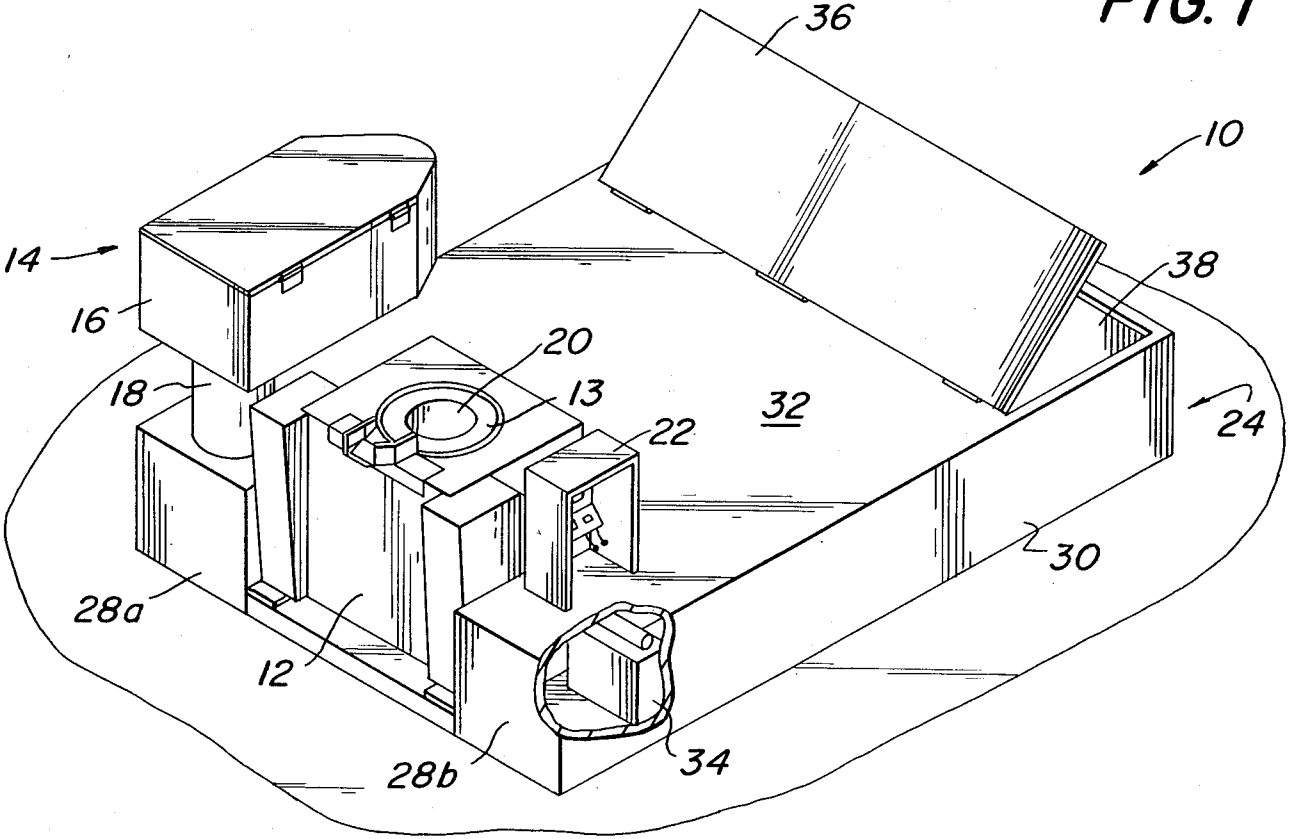
FIG. 1 is an isometric view of a furnace packaging system in accordance with the present invention.

Referring now to the drawings, wherein like numerals indicate like elements, there is shown in FIG. 1 a furnace packaging system in accordance with the present invention designated generally by the reference numeral 10. The system includes a conventional induction furnace 12 and a charging conveyor 14. Induction furnace 12 may be any conventional induction furnace, and therefore need not be described in further detail here, except to note that furnace 12 is preferably provided with a lining 13 which is removable from furnace 12 when the lining has become worn out. Charging conveyor 14 is also conventional, and includes a hopper 16 mounted on a post 18, and is arranged to pivot over furnace cover 20 to feed material to be melted into furnace 12. Because charging conveyor 14 is conventional, it is not necessary to explain it in any great detail here.

The furnace packaging system 10 includes an equipment housing 24 which houses all of the furnace operating equipment internally with the exception of operator control console 22, which contains the controls, switches, meters, and the like, which must be readily accessible to an operator.

Housing 24 includes a base 26, side walls **28*a*, 28*b* and 30, and cover 32. Cover 32 forms a deck on which workmen and furnace operators can stand. Housing 24 also includes a side wall 54 opposite side walls 28*a*, 28*b* and a side wall (not visible in FIG. 1) opposite side wall 30. Base 26, the side walls and cover 32** define an enclosed space within which is located the furnace operating equipment.

Figure 2:
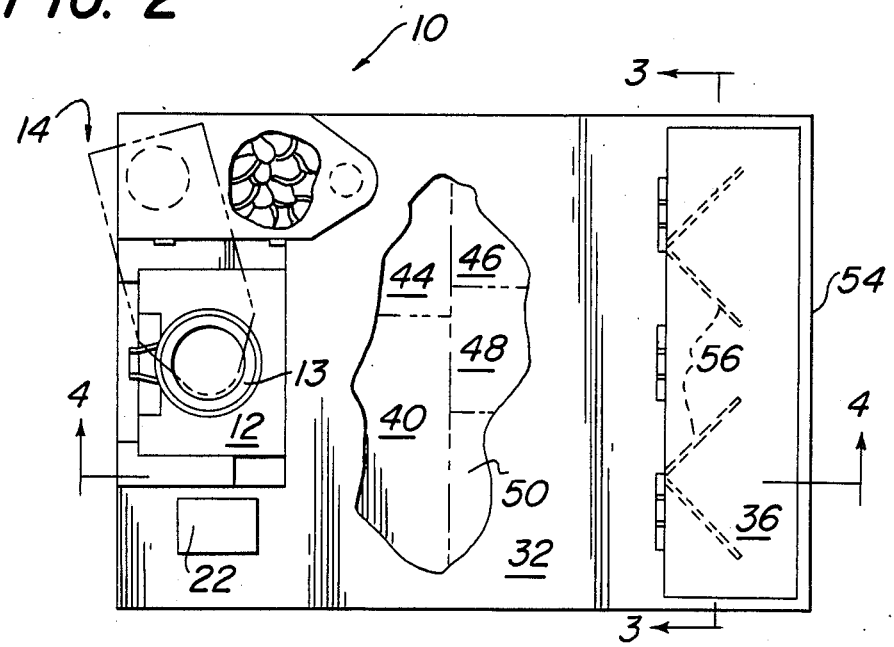
FIG. 2 is a plan view of the furnace packaging system shown in FIG. 1.
Figure 3:
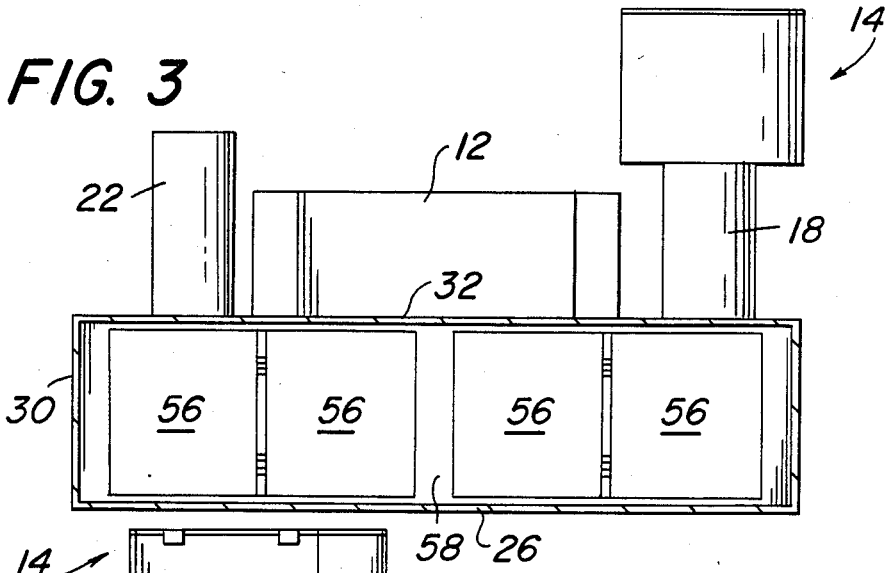
FIG. 3 is a sectional view taken along the lines 3—3 in FIG. 2.
Figure 4:
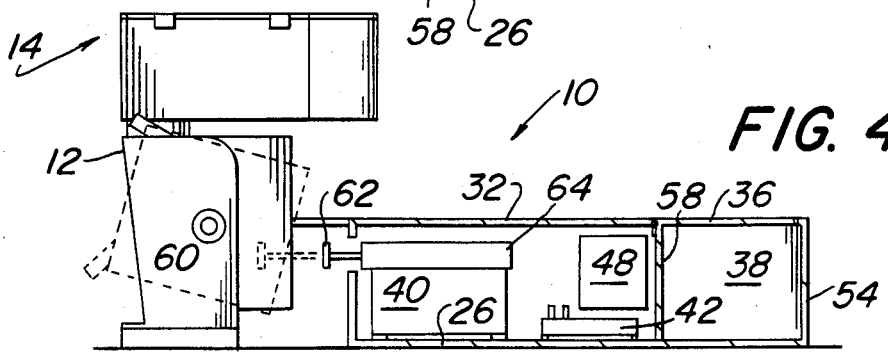
FIG. 4 is a sectional view taken along the lines 4—4 in FIG. 2.

As best illustrated in FIGS. 2 and 3, conventional induction furnace operating equipment such as hydraulic power supply 34, lining ejector 40, current limiting reactors 42, automatic circuit interruptor 44, air-operated disconnects 46, dc filter 48 and power factor correction capacitors 50 are all enclosed within housing 24. Also enclosed within housing 24 are the electrical connections between the operating equipment and furnace 12. The specific types of operating equipment enumerated are illustrative only and the invention is not limited to enclosing any specific equipment or combinations or equipment, nor is the invention limited to their relative placement within housing 24.

Access to the furnace operating equipment is by means of access panel 36 in cover 32. Access panel 36 may be hingedly mounted in cover 32 or may be removably mounted therein. Access panel 36 when raised provides access to space 38, which is large enough to permit a workman to enter therein in order to maintain and/or repair the furnace operating equipment. When access panel 36 is lowered, it fits flush with the surface of cover 32 so as to form a continuous deck. The deck may be refractory-lined for metal splash protection.

As seen in FIGS. 2 and 3, a plurality of vertically-hinged access doors 56 are provided in interior wall 58 of housing 24. Interior wall 58 helps shield the furnace operating equipment from space 38, while doors 56 provide access to the equipment when necessary.

Access panel 36 may also be located in one or more of the side walls of housing 24. However, when access panel 36 is located in cover 32, a number of furnaces 10 may be grouped together in abutting relationship, minimizing required floor space while still permitting easy and safe access to the furnace operating equipment.

Located within housing 24 and associated with hydraulic power supply 34 are means such as hydraulic cylinders (not shown) for tilting furnace 12 about an axis 60 perpendicular to the axis of the furnace. Means for tilting furnace 12 are known and need not be described here in detail.

Lining ejector 40 is located within housing 24 adjacent furnace 12 and comprises a hydraulic ram 62 extendible and retractable by hydraulic cylinder 64. As will be understood by those skilled in the art, ram 62 is extended to at least partially eject removable lining 13 from furnace 12 so that lining 13 can be removed and replaced when worn out.

It will be appreciated that, except for the operator control console which must be located above deck level, all of the furnace operating equipment is enclosed safely within housing 24 so that risk of damage to the operating components is greatly minimized. Moreover, instead of having to work on the furnace operating equipment from above, workmen have access to the equipment from the sides by means of access spaces 38. This simplifies maintenance by allowing access to the equipment from two sides rather than from just the top.

The present invention may be embodied in other specific forms without departing from the spirit or essential attributes thereof and, accordingly, reference should be made to the appended claims, rather than to the foregoing specification, as indicating the scope of the invention.

I claim:

1. A packaging system for an induction furnace comprising:

(a) housing means having a base, side walls and a top wall, the base, top and side walls defining an enclosed space, (b) an induction furnace contained substantially within the enclosed space, the induction furnace having a removable liner, (c) means for tilting the furnace about an axis perpendicular to the furnace axis located within the enclosed space, (d) furnace operating equipment centrally located within the enclosed space and defining a space between the furnace operating equipment and a side wall of the housing means, said furnace operating equipment including means operatively associated with the furnace for at least partially ejecting the removable liner from the furnace, (e) access means in the top wall adjacent the space between the furnace operating equipment and the side wall for providing access to the space and access to the furnace operating equipment from the side thereof while preventing access to the furnace operating equipment from the top thereof, (f) induction furnace charging means mounted on the housing means adjacent the induction furnace and pivotable with respect thereto for charging the induction furnace with metal to be melted, and (g) furnace control housing means mounted on the top wall and adjacent the induction furnace.

2. A packaging system according to claim 1, wherein the access means comprises at least one panel flush with the top wall and hingedly mounted therein.

3. A packaging system for an induction furnace comprising:

(a) a substantially rectangular housing having a base, side walls and a top wall and defining an enclosed space therein, (b) an induction furnace at one end of the housing and contained substantially within the enclosed space, the induction furnace having means extending above the top wall of the housing for receiving a charge of metal to be melted by the furnace and having a removable liner, (c) means for tilting the furnace about an axis perpendicular to the furnace axis located within the enclosed space, (d) furnace operating equipment centrally located within the enclosed space at the end of the housing opposite the induction furnace and defining a channel between the furnace operating equipment and a side wall of the housing, said furnace operating equipment including means operatively associated with the furnace for at least partially ejecting the removable liner from the furnace, (e) a hinged access panel in the top wall above the channel between the furnace operating equipment and the side wall for providing access to the channel and access to the furnace operating equipment from the sides thereof while preventing access to the furnace operating equipment from the top thereof, (f) induction furnace charging means mounted on the housing means adjacent the induction furnace and pivotable with respect thereto for charging the furnace with metal to be melted, and (g) furnace control housing means mounted on the top wall and adjacent the induction furnace, and having a back wall adjacent the furnace and side walls and a top wall extending away from the furnace, the furnace control housing being substantially open along a plane parallel to the back wall and spaced apart therefrom by the length of the side and top walls of the furnace control housing.

* * * * *